US005425312A

United States Patent [19]

Tack, Jr.

[11] Patent Number: 5,425,312

[45] Date of Patent: Jun. 20, 1995

[54] STABILIZED PEDESTAL WEAR PLATE

[75] Inventor: Carl E. Tack, Jr., Oak Park, Ill.

[73] Assignee: Trans-Dyne Incorporated, Chicago, Ill.

[21] Appl. No.: 730,113

[22] Filed: Jul. 15, 1991

[51] Int. Cl.[6] ..... B61F 5/32; B61F 5/38

[52] U.S. Cl. ..... 105/225; 105/218.1

[58] Field of Search ..... 105/218.1, 222, 224.1, 105/225

[56] References Cited

U.S. PATENT DOCUMENTS

| | | | |
|---|---|---|---|
| 1,964,671 | 6/1934 | Nesbitt | 384/625 X |
| 2,648,573 | 8/1953 | Wheldon, Jr. | 384/42 |
| 3,408,121 | 10/1968 | Pinney | 105/224.1 |
| 3,785,298 | 1/1974 | Reynolds | 105/218.1 |
| 3,844,226 | 10/1974 | Brodeur et al. | 105/224.1 |
| 3,897,736 | 8/1975 | Tack | 105/225 |
| 4,170,180 | 10/1979 | Houston | 105/225 |
| 4,203,371 | 5/1980 | Tack | 105/225 |
| 4,239,007 | 12/1980 | Kleykamp et al. | 105/225 |
| 4,440,095 | 4/1984 | Mathieu | 384/42 X |
| 4,471,857 | 9/1984 | Murphy | 188/205 R |
| 4,926,757 | 5/1990 | Spencer | 105/224.1 |
| 4,991,864 | 2/1991 | Potsch | 280/484 |

*Primary Examiner*—Robert J. Oberleitner
*Assistant Examiner*—Kevin D. Rutherford
*Attorney, Agent, or Firm*—Juettner Pyle Lloyd & Piontek

[57] ABSTRACT

A clip-on wear plate to protect the downwardly facing flat surface of the pedestal opening of a railway truck is provided. The wear plate has a first flat surface in contact with the downwardly facing flat surface of the pedestal and an opposed second surface in contact with the bearing adaptor. The first surface is provided with a relatively high coefficient of friction relative to the second surface to an minimize movement of the wear plate.

3 Claims, 1 Drawing Sheet

STABILIZED PEDESTAL WEAR PLATE

BACKGROUND OF THE INVENTION

This invention relates to improvements in wear plates which are designed for convenient and removable installation in the pedestal opening of the side frame of a railway truck. More particularly, the invention relates to a clip-on pedestal wear plate of a known type which has an upwardly and downwardly facing surface and wherein the upper surface provides relatively higher friction than the lower surface to improve stability of the plate.

Clip-on pedestal wear plates are described in U.S. Pat. No. 3,897,736 and U.S. Pat. No. 4,203,371. The plate comprises a base adapted to cover and protect the downwardly facing surface of the pedestal opening. The plate includes a pair of lips joined to and extending upward from opposite sides of the base, said lips being resiliently engageable in clamped relation with opposite sides of the pedestal above the downwardly facing surface. The function of this type of wear plate is to prevent wear on the pedestal roof from a bearing adaptor, which is located over the axle bearing of the axle and wheel assembly of the truck. In the absence of a wear plate, limited movement or frictional sliding would occur directly between the arcuate top of the bearing adaptor and pedestal roof, causing worn spots on the roof, which is part of the side frame casting. The worn roof would have to be ground down and renewed by welding a plate in the opening, a time consuming and expensive procedure.

In most recent times, various proposals have been made to reduce the friction or absorb energy generated by engaging or load bearing parts in railway trucks, primarily to reduce wear or to improve performance characteristics. For example, the use of resilient shear pads are disclosed in U.S. Pat. Nos. 3,381,629, 3,638,582 and 4,363,278.

In addition, the use of low coefficient high density plastic liners at various locations in the railway truck have been proposed and placed in commercial use, for example, in U.S. Pat. Nos. 4,170,180 and 4,380,199. Polymeric liners, however, may be subject to abrasion when disposed against a rough steel part. Also, polymer liners are electrically non-conductive, and it is generally desirable to provide a conductive path from the rails and through the truck to the car body, in order to prevent build up of static electricity. Hence, if a non-conductive insert is employed in the pedestal roof, a separate conductive path would have to be provided.

In the manufacture and use of clip-on wear plates, it would be desirable to minimize movement of the wear plate relative to the side frame and to confine any movement to that between the wear plate and the bearing adaptor. Excessive movement of the wear plate itself causes high stresses in the lips and may lead to premature failure.

SUMMARY OF THE INVENTION

In accordance with the present invention, a clip-on wear plate is provided and has an upwardly facing surface flat in contact with the pedestal of the side frame and a downwardly facing flat surface in contact with the bearing adaptor. Means are provided on one or both of said surfaces such that the coefficient of friction on the downwardly facing surface is substantially lower than the upwardly facing surface. This greatly improves the stability of the wear plate and minimizes stresses therein which would otherwise tend to fatigue the plate. Also, decreasing the friction between the plate and the bearing adaptor may be beneficial in some applications which call for a limited degree of lateral movement between the side frames and wheel and bearing assemblies.

In the preferred embodiment, the lower surface of the wear plate may be finished to a high degree of smoothness. In the alternative, a coating or layer of electrically conductive and lubricating material may be provided on the lower surface. Finally, either alone or in combination with either of the above steps, a coating or layer of high friction material may be provided on the upper surface of the plate to increase the relative static friction between the plate and the pedestal roof.

THE DRAWINGS

DESCRIPTION OF THE PREFERRED EMBODIMENTS

Figure 1:
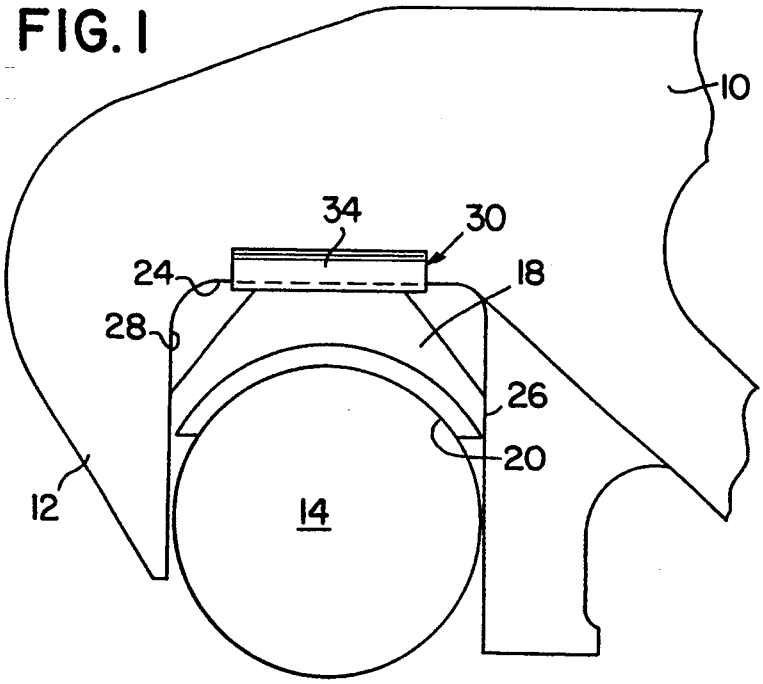
FIG. 1 is a simplified side view of one end of a railway truck, illustrating the pedestal, wear plate, bearing adaptor and axle.

The structure of the pedestal wear plate is substantially as described in U.S. Pat. No. 3,897,736. FIG. 1 illustrates one end of a side frame 10 terminating in the pedestal 12 in the form of a downwardly open pedestal jaw engaged over the axle 14 on which the car wheels are mounted.

Figure 2:
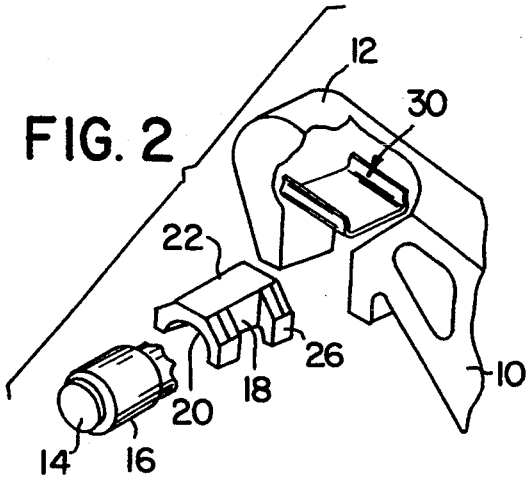
FIG. 2 is an exploded view of the assembly shown in FIG. 1.

As shown in FIGS. 1 and 2, a roller bearing 16 is carried on the axle 14 near the end thereof, and a bearing adaptor 18 is provided between the top portion of the bearing and the internal surfaces of the pedestal 12. The downwardly facing surface of the adaptor 18 is curved at 20 to correspond to the cylindrical outer race of the bearing 16, and the upper portion of the adaptor comprises a top slightly convex surface 22 which normally bears against a downwardly facing flat surface 24 in the pedestal opening. In addition, side surfaces 26 are provided on the adaptor 18 in engagement with corresponding surfaces 28 in the pedestal opening. Thus the upper portion of the adaptor is generally rectangular so as to be received in the rectangular pedestal opening, although the adaptor corners are omitted or cut away to prevent galling of the corners in the pedestal opening.

The foregoing parts are conventional and details thereof are readily available to the public. It will also be understood that the pedestal at the other end of the side frame is identical to the one described above.

Figure 3:
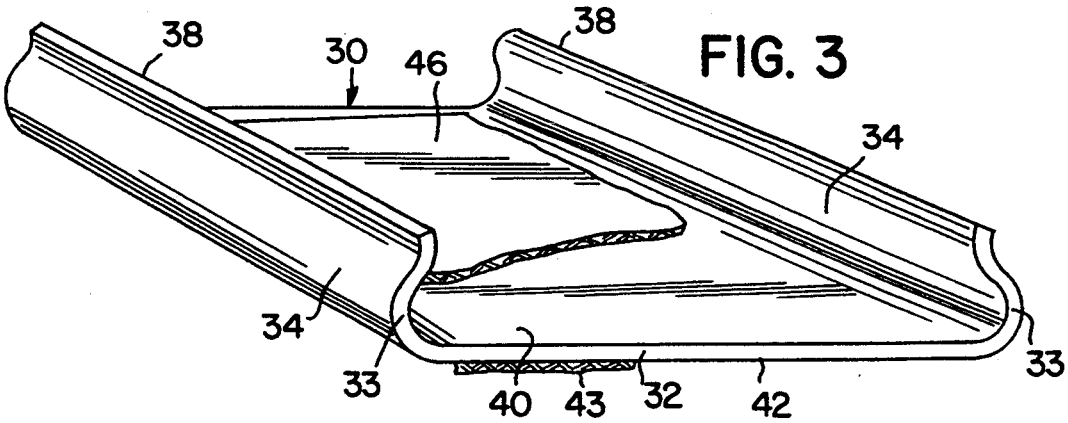
FIG. 3 is a perspective view of the wear plate which is modified in accordance with the teachings of the present invention.

As shown in FIGS. 1 and 3, the wear plate 30 is in the form of a rectangular base plate 32, said plate having a pair of integrally formed lips 34 extending upwardly from opposite sides thereof, said lips being adapted to resiliently clamp inward toward one another against the opposite side surface of the pedestal 12 adjoining the central portion of the downwardly facing surface or roof 24. As shown, the lips 34 are coextensive with the length of the base plate 32, which facilitates fabrication of the wear plate from a single rectangular metal or steel sheet, although any suitable lip configuration may be employed. It will be noted that the base of the lips 34 each bulge outwardly in an arc at 33 beyond the width of the base plate 32, and the upper edges 38 are inwardly spaced from the base of the lips but are also flared out at their ends to facilitate installation.

The minimum dimension between the lips 34 is smaller than the width of the base plate 32 and the transverse thickness of the pedestal, such that the lips resiliently clamp against the sides of the side frame after the wear plate has been installed. The bulges 33 in the lips serve to accommodate corresponding bulges which are normally cast in the side frame. The clamping action of the lips 34 against the side frame serve to minimize side-to-side movement of the wear plate relative to the frame.

In accordance with the present invention, means are provided on the opposed bearing surfaces 40 and 42 of the wear plate 30 to provide a coefficient of friction differential therebetween. Since the upwardly facing surface 40 and the downwardly facing surface 42 have approximate equal areas, the amount of friction associated between each surface and its engaged part would be substantially equal. The surfaces 40 and 42 are treated or otherwise altered such that the engagement between the upper surface 40 and pedestal roof 24 provides a greater static coefficient of friction than the lower surface 42 and the top 22 of the bearing adaptor 18. This friction differential minimizes movement of the wear plate relative to the side frame, with any horizontal movement being allowed substantially between the lower surface 42 and bearing adaptor 18. This, in turn, minimizes stress and fatigue on the wear plate, particularly along the bulges along the sides, and confines any wear to the lower surface and adaptor interface.

The provision of the aforesaid friction interface differential may be provided in several ways, namely, by increasing the upper friction interface, decreasing the lower friction interface, or a combination of both.

In order to decrease the lower friction interface, the downwardly facing surface 42 may be finished such as by grinding and polishing to reduce the coefficient of friction of the steel surface, which may otherwise have a coefficient of friction of up to about 0.6. The resulting surface should have a smoothness of less than 128 micro-inches. The upper surface 40 would be unfinished and would remain substantially rough.

In the alternative, a layer or coating of an electrically conductive material 43 may be applied to the lower surface 42. Such material could comprise, for example, a thin rectangular piece of stainless steel applied with an adhesive, or a coating or layer of relatively soft metal, such as non-ferrous, such as copper, lead or zinc, and various alloys. Other types of conductive lubricating materials could be employed, such as graphite and other inorganic conductive lubricants.

The second alternative is to apply a layer or other coating to the upwardly facing surface in order to increase the static coefficient of friction between such surface and the pedestal roof. In such event, the coating or layer, such as indicated at 46, may be non-conductive, since a conductive path will be maintained between the lips of wear plate and the side frame. A wide variety of materials may be employed to increase the coefficient of friction, such as mildly abrasive materials and materials which offer a tacky surface. As one example, the layer 46 may comprise the thin sheet of friction material, such as a polymer containing reinforcing fiber and friction modifying particles. The materials may be painted or coated as a layer on the upper surface or a thin layer of abrasive or tacky material may be applied with a suitable adhesive.

The present invention offers considerable advantages over prior art clip-on wear plates which were constrained by mechanical means such as lugs on the pedestal or dimples in the pedestal roof. These prior mechanical arrangements required special and labor intensive installation procedures and were not highly effective.

I claim:

1. An improved pedestal wear plate for a railway truck wherein the wear plate is located in the pedestal opening of the side frame of the truck between the flat pedestal roof and the bearing adaptor for the wheel and axle assembly, said pedestal wear plate comprising an upwardly facing flat surface disposed against the flat pedestal roof at a first interface, a downwardly facing flat surface disposed against the bearing adaptor at a second interface, means for resiliently clipping the wear plate to the side frame, and means comprising a flat layer of relatively high friction material on said upwardly facing surface for providing a static coefficient of friction which is substantially greater at said first interface than said second interface in order to minimize movement of said wear plate relative to said side frame.

2. An improved pedestal wear plate for a railway truck wherein the wear plate is located in the pedestal opening of the side frame of the truck between the flat pedestal roof and the bearing adaptor for the wheel and axle assembly, said pedestal wear plate comprising an upwardly facing flat surface disposed against the flat pedestal roof at a first interface, a downwardly facing flat surface disposed against the bearing adaptor at a second interface, means for resiliently clipping the wear plate to the side frame, and metals for providing a static coefficient of friction which is substantially greater at said first interface than said second interface in order to minimize movement of said wear plate relative to said side frame, wherein said means for providing a static coefficient of friction at said first interface than said second interface, together with the means for resiliently clipping the wear plate to the side frame, constitute the sole means to minimize said movement of said wear plate.

3. The improved wear plate of claim 2, wherein said wear plate is disposed under compression between the pedestal roof and the bearing adaptor.

* * * * *